US006886459B2

(12) United States Patent
Khalid

(10) Patent No.: US 6,886,459 B2
(45) Date of Patent: May 3, 2005

(54) DOUBLE-SIDED HIGH SPEED PRINTING APPARATUS AND METHOD

(75) Inventor: Najeeb Khalid, Westmount (CA)

(73) Assignee: Escher-Grad Technologies, Inc., Lachine (CA)

( * ) Notice: Subject to any disclaimer, the term of this patent is extended or adjusted under 35 U.S.C. 154(b) by 0 days.

(21) Appl. No.: 10/366,474

(22) Filed: Feb. 14, 2003

(65) Prior Publication Data

US 2004/0159250 A1 Aug. 19, 2004

(51) Int. Cl.[7] ..... B41F 13/56

(52) U.S. Cl. ..... 101/225; 347/40; 347/104; 347/105

(58) Field of Search ..... 101/225, 227, 101/228; 347/40, 104, 105, 154

(56) References Cited

U.S. PATENT DOCUMENTS

| | | | | |
|---|---|---|---|---|
| 4,882,621 | A | 11/1989 | Suzuki et al. | 358/80 |
| 5,294,946 | A | 3/1994 | Gandy et al. | 346/140 |
| 5,764,263 | A | 6/1998 | Lin | 347/101 |
| 5,812,151 | A | 9/1998 | Kishine et al. | 346/44 |
| 5,966,145 | A | 10/1999 | Miura et al. | 347/9 |
| 5,984,454 | A | 11/1999 | Takahashi et al. | 347/43 |
| 5,988,791 | A | 11/1999 | Miyashita et al. | 347/43 |
| 6,042,228 | A | 3/2000 | Yamada et al. | 347/104 |
| 6,089,695 | A | 7/2000 | Takagi et al. | 347/40 |
| 6,142,622 | A | 11/2000 | Blanchard, Jr. et al. | 347/104 |
| 6,309,046 | B1 * | 10/2001 | Izawa et al. | 347/40 |
| 2002/0008746 | A1 | 1/2002 | Naniwa et al. | 347/89 |

* cited by examiner

*Primary Examiner*—Daniel J. Colilla
*Assistant Examiner*—Marissa Ferguson
(74) *Attorney, Agent, or Firm*—Ogilvy Renault

(57) ABSTRACT

An apparatus for double-sided high-speed printing on a continuous sheet of printable material having a first guide, a second guide, a third guide, and a fourth guide providing a first print area between the first and second guides for printing on a first side of the material and a second print area between the third and fourth guides for printing on a second side of the material. A first plurality of print heads print in the first print area and a second plurality of print heads print in the second print area. The first and second plurality of print heads all fire in a same direction. Bends in the material provided by the guides permit a compact arrangement that eliminates flutter of the material in the print areas.

11 Claims, 3 Drawing Sheets

DOUBLE-SIDED HIGH SPEED PRINTING APPARATUS AND METHOD

CROSS-REFERENCE TO RELATED APPLICATIONS

This is the first application filed for the present invention.

TECHNICAL FIELD

This invention relates to ink-jet printers and particularly to those having a plurality of ink-jet heads for printing on both sides of a continuous strip of printable material.

BACKGROUND OF THE INVENTION

One important requirement for high quality ink-jet printing is that there be an unvarying distance between ink-jet print head nozzles and a print surface of the strip of paper to be printed.

Prior art attempts to provide this constant distance used a fixed, flat platen. Such attempts have proved unsatisfactory when incorporated in multiple print head ink-jet printers in which a plurality of ink-jet print heads are aligned along a predefined path of a continuous strip of paper or like printable material. Consider an elongated flat platen mounted opposite to the series of ink-jet print heads, and with the paper strip fed over the platen by guide rollers or pairs of feed rollers disposed adjacent to both ends of the platen. The paper strip is prone to flutter over the platen because of the extended distance between the guide rollers or the like that is necessary to permit all of the print heads to print on the paper without roller means that lead to smudging of freshly deposited ink. This fluttering gives rise to unacceptable variations in the spacing between the printable material surface and the print heads.

U.S. Pat. No. 6,309,046, which issued to Izawa et al. on Oct. 30, 2001, teaches an ink-jet printer having a plurality of ink-jet heads for printing on a continuous strip of paper. However, Izawa et al. require a turnover station between a first and a second printing station in order to provide printing on both sides of the paper. Also, the ink-jet print heads are oriented in a plurality of directions, and ink can be smudged when passing over a roller guide.

SUMMARY OF THE INVENTION

It is an object of the invention to provide an apparatus and method for conducting a continuous sheet of printable material through a printing apparatus to permit printing on both a first side and a second side of the material for high-speed double-sided printing. The apparatus is compact, eliminates flutter and smudging, and has an arrangement of print heads that fire in one direction.

Accordingly an apparatus for conducting a continuous sheet of printable material through a printing apparatus to permit printing on both a first side and a second side of the material, is provided. The apparatus comprises four parallel guides, each providing for respective bends in the material. The first and fourth bends are provided sequentially in a first sense while the second and third bends are in an opposite sense, so that between the first and second bend, and between the third and fourth bend, two print areas are provided that expose opposite sides of the printable material to respective sets of print heads wherein all the print heads are oriented in the same direction. The distance between the print heads in each of the respective sets is limited and consequently the first and the second guides (and equally the third and fourth guides) are separated by a distance that is small enough that flutter is not a problem. The guides may be rollers.

Each of the first bend, the second bend, the third bend and the fourth bend may have a magnitude of substantially 90°.

The first guide and the fourth guide preferably contact only a first side of the printable material, that is printed on by the first set of print heads, the second guide and third guide contact only the second side of the material. Consequently after ink is imparted onto the first side, the printable material travels a distance spanned by two rollers before encountering a roller. The distance spanned between the second to fourth rollers is preferably about 20 inches, a distance needed to dry oil-based ink.

Preferably the first and second sets of print heads printed cyan, magenta, yellow, and black (CMYK) color monochromatic images that when overlaid produce a seamless color image. Alternatively, multiple print heads may be used to print high resolution monochrome images.

The printable material may be paper, film, metal, or cloth, for example.

The method for printing on both a first side and a second side of a continuous sheet of printable material, provided in accordance with the object of the invention, involves bending the material four times by four respective guides, and printing on the first and second sides between the first and second, and third and fourth bends, respectively.

BRIEF DESCRIPTION OF THE DRAWINGS

Further features and advantages of the present invention will become apparent from the following detailed description, taken in combination with the appended drawings, in which.

It should be noted that throughout the appended drawings, like features are identified by like reference numerals.

DETAILED DESCRIPTION OF THE PREFERRED EMBODIMENT

Figure 1:
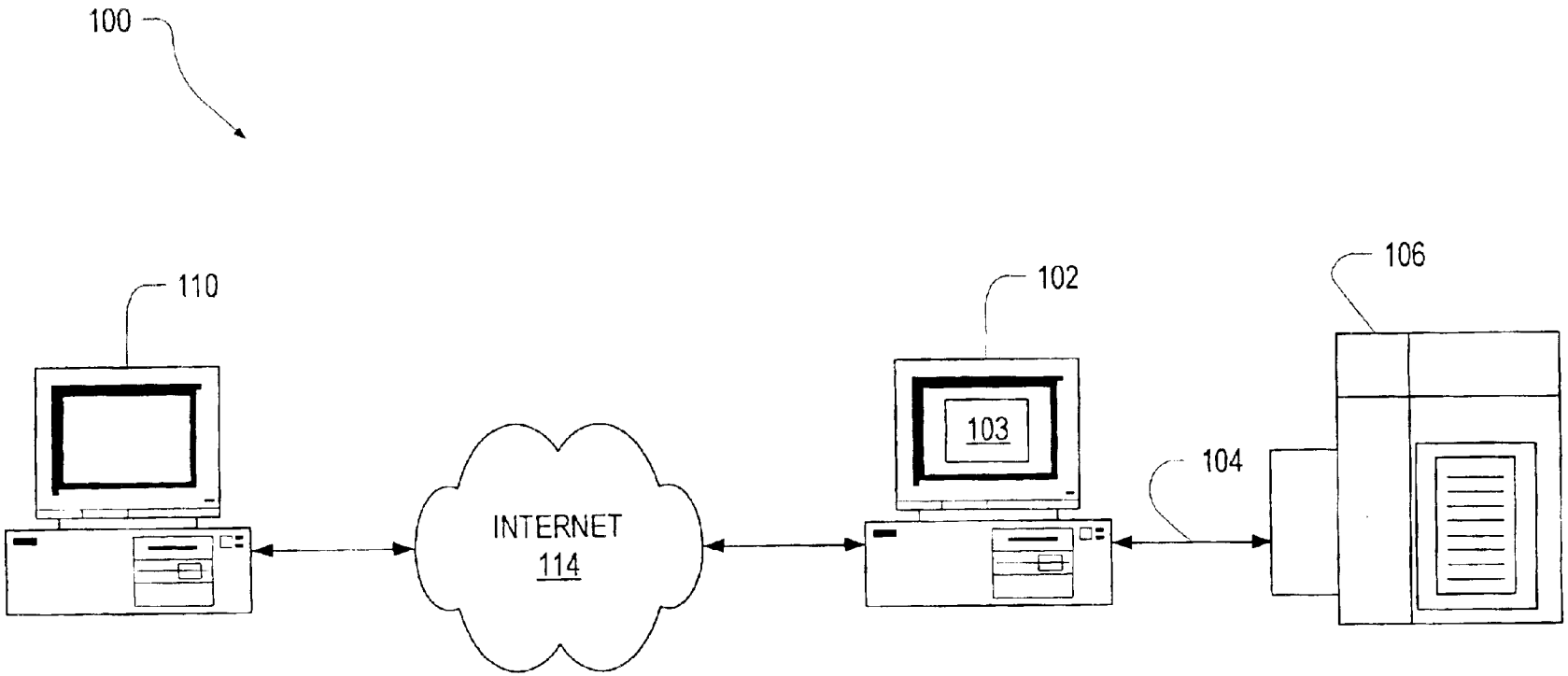
FIG. 1 is a schematic diagram of an environment of a printing apparatus in accordance with the invention.

FIG. 1 is a schematic diagram illustrating an environment 100 in which the invention may be deployed; the environment 100 comprising a computer 102 connected 104 to a printer 106. The connection 104 may be a computer network such as Ethernet; a serial connection such as universal serial bus (USB) or IEEE 1394; a parallel port connection; or a wireless connection such as Bluetooth or IEEE 802.11b. The computer 102 preferably includes a print manager 103. A plurality of remote computers 110 (only one shown for convenience) may also be communicatively coupled to the computer 102 via a packet switching network such as the Internet 114. Images (not shown) 110 may be transferred from the remote computer 110 via the Internet 114 to the print manager 103 in the computer 102, or may originate in the computer 102.

Figure 2:
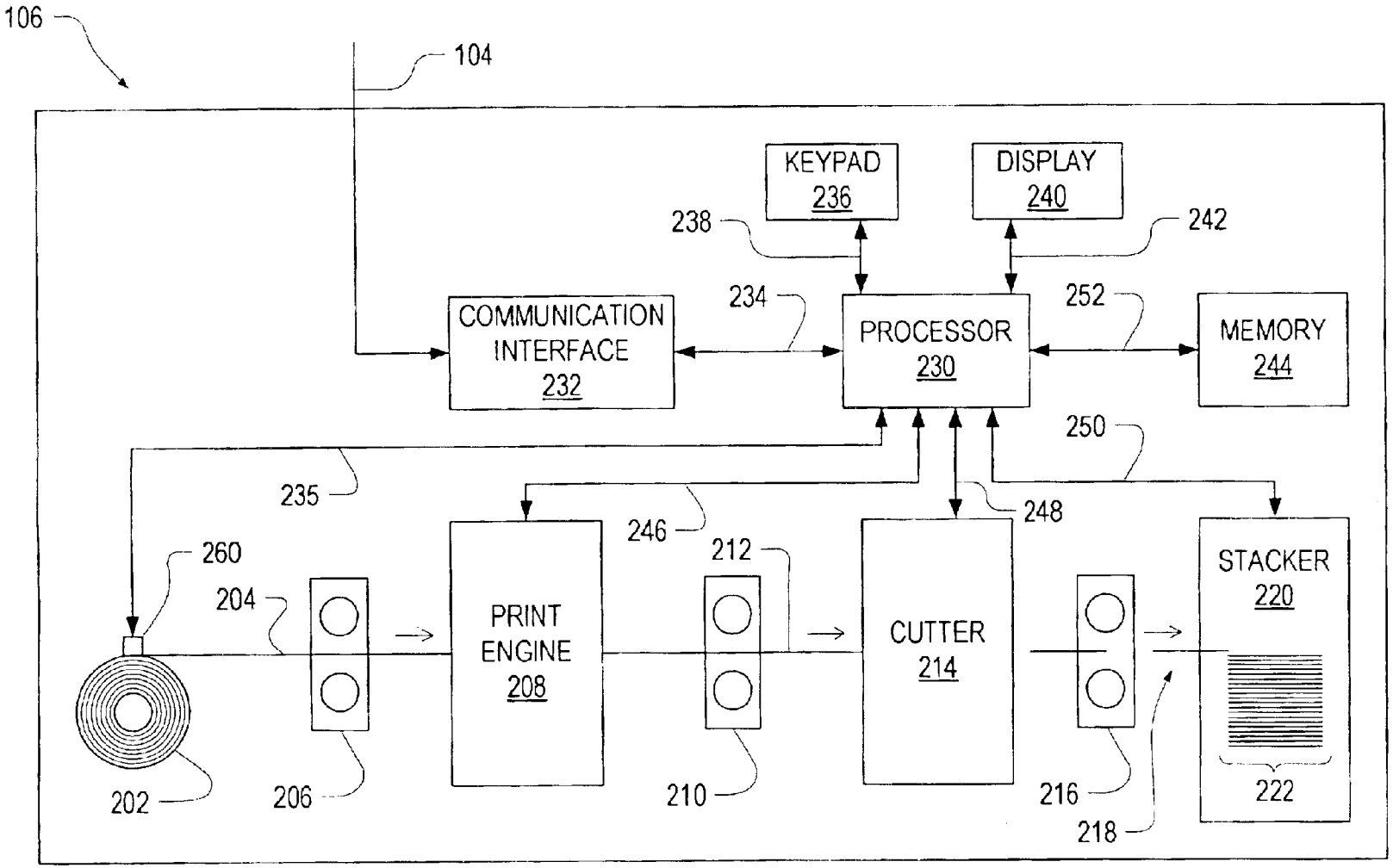
FIG. 2 is a block diagram of the printing apparatus shown in FIG. 1.

FIG. 2 is a block diagram of the printing apparatus 106 shown in FIG. 1. The printing apparatus 106 receives a source of printable material 204 which is preferably a web 202. The printable material 204 may be, for example, paper, film, metal, or cloth. The printing apparatus 106 therefore includes a first feed mechanism 206 for feeding the printable material 204 from the web 202 to a print engine 208, which is preferably an ink-jet print engine.

The print engine 208 prints images onto the printable material 204, which may be, for example, two or three dimensional images; holographic images; text; or any combination thereof. The print engine 208 prints on both sides of the printable material 204 to produce printed material 212 as described herein below. The printing apparatus 106 has a second feed mechanism 210 for feeding the printed material 212 from the print engine 208 to a cutter 214.

The cutter 214 cuts the printed material 212 into pages 218 of a predetermined size, such as letter, legal or A4. The cutter 214 may include, for example, a blade, a laser or a shearing mechanism. The printing apparatus 106 also has a third feed mechanism 216 for feeding the sheets 218 from the cutter 214 to a stacker 220.

The stacker 220 is adapted to lay the pages 218 in sequence on a stack 222. The stacker 220 may be, for example, a mechanism for sorting and/or collating documents; or a tray for receiving pre-sorted/pre-collated documents.

The preferred embodiment of the printing apparatus 106 includes a processor 230 coupled by a connection 235 to a sensor 260 to sense a condition of the web 202, such as a "source empty" condition. The processor 230 is coupled by a connection 246 to the print engine 208 for transferring images to the print engine 208; coupled by a connection 248 to the cutter 214 for controlling the cutter 214 to cut the printed material 212 into pages and flag sheets; and coupled by a connection 250 to the stacker 220 for controlling the stacker 220 and sensing a condition of the stacker 220 such as a "tray full" condition.

The printing apparatus 106 also includes a communication interface 232 coupled by a connection 234 to the processor 230, and adapted to communicate with the computer 102 (FIG. 1) via the connection 104. The processor 230 is also coupled by a connection 238 to a keypad 236 for a user (not shown) to input commands to the processor 230, and coupled by a connection 242 to a display 240 to permit the user to observe messages generated by the processor 230. A memory 244 is also coupled to the processor 230 by a memory bus 252.

Figure 3:
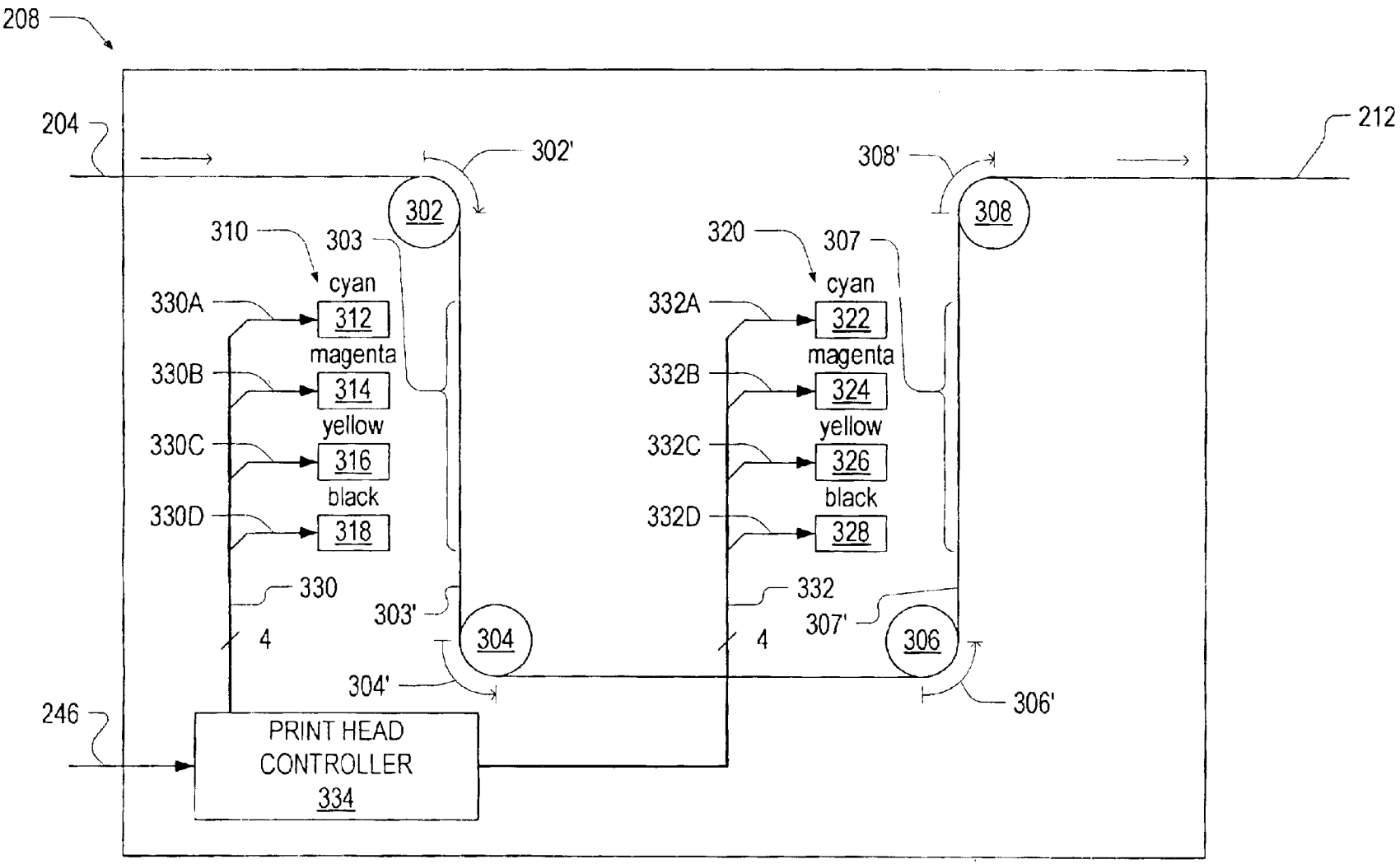
FIG. 3 is a diagram of a print engine shown in FIG. 2.

FIG. 3 is a block diagram of a preferred embodiment of the print engine 208 shown in FIG. 2 including: a first guide 302 providing a first bend 302' having a first sense in the printable material 204, a second guide 304 providing a second bend 304' having a second sense in the printable material 204, a third guide 306 for providing a third bend 306' having the second sense in the printable material 204, and a fourth guide 308 for providing a fourth bend 308' having the first sense in the printable material 204. While the first, second, third and fourth bends 302, 304, 306 and 308 are shown having magnitudes 302', 304', 306' and 308' of substantially 90°, other magnitudes are within the scope of the invention.

The print engine 208 includes a first plurality of print heads 310 for printing in a first printing area 303 between the first guide 302 and the second guide 304 on a first side 303' of the printable material 204. In the illustrated embodiment, the first plurality of print heads 310 comprises ink-jet print heads for printing cyan 312, magenta 314, yellow 316, and black 318 (CMYK). All of the ink-jet print heads 312, 314, 316, 318 are identical except for a source of ink (not shown) in order to facilitate maintenance. Alternatively, the first plurality of print heads 310 may be supplied a same color of ink, (not shown), to produce high resolution printing of monochromatic images.

The print engine 208 also includes a second plurality of print heads 320 for printing in a second print area 307 between the third guide 306 and the fourth guide 308 on a second side 307' of the printable material 204. The second plurality of print heads 320 is substantially the same as the first plurality of print heads 310 in operation.

In accordance with the preferred embodiment of the print engine 208 the ink used is oil-based, eliminating a need for a drying station. Oil-based inks do not run as water-based inks tend to do. The use of oil-based ink further mitigates plastic deformation produced by many types of printable material when dampened while under tension of the rollers. These effects are well known in the art of printing. Using oil-based ink, after moving 20 inches from a place where it was deposited (assuming high-speed rates of paper feeding), the ink will have dried enough so that it can pass over a roller without risk of smudging.

Advantageously, both pluralities of printing heads 310, 320 are arranged in similar configurations, with the ink-jets 312, 314, 316, 318, 322, 324, 326, 328, oriented to fire in the same horizontal direction. Thus, a "half-twist" or turn-over station between the second guide 304 and third guide 306 is not required.

The print engine 208 has a print head controller 334 for: receiving images from the processor 230 (FIG. 2), sending printing command signals 330A, 330B, 330C, 330D via a first bus 330 to respective print heads 312, 314, 316, 318 in the first plurality of print heads 310, and sending print command signals 332A, 332B, 332C, 332D over a second bus 332 to respective print heads 322, 324, 326, 328 in the second plurality of print heads 320.

The first guide 302, the second guide 304, the third guide 306, and fourth guide 308 are preferably rollers wherein: the first guide 302 only contacts the first side 303' of the printable material 204 and the second guide 304 only contacts the second side 307' of the printable material 204. Advantageously, this permits a compact arrangement of the first guide 302 and the second guide 304 thereby eliminating flutter of the printable material 204 in the first printing area 303, as well as eliminating smudging of the ink by the second guide 304. Similarly, a compact arrangement of the third guide 306 and the fourth guide 308 is permitted thereby eliminating flutter of the printable material 204 in the second printing area 307, as well as eliminating smudging of the ink by the fourth guide 308. The distance between the second guide 304 and the third guide 306 is large enough to allow the oil based ink to be absorbed by the first side 303' of the printable material 204 before it passes to over the fourth guide 308.

The invention therefore provides a high speed double-sided printing apparatus that is compact, eliminates flutter and smudging, and has an arrangement of print heads oriented to fire in a same direction.

The embodiments of the invention described above are intended to be exemplary only. The scope of the invention is therefore intended to be limited solely by the scope of the appended claims.

I claim:

1. A printing apparatus for printing on both sides of a moving, continuous sheet of printing material, the apparatus comprising:

a first guide in contact with a first side of the sheet;

a second guide in contact with second side of the sheet;

a first print head disposed between the first guide and the second guide for printing on the first side;

a third guide in contact with the second side of the sheet, a fourth guide in contact with the first side of the sheet; and a second print head disposed between the third guide and the fourth guide for printing on the second side.

2. The printing apparatus as claimed in claim 1 wherein the guides are rollers.

3. The printing apparatus as claimed in claim 2 wherein each of the rollers defines a right-angle bend.

4. The printing apparatus as claimed in claim 1 wherein the first print head is disposed substantially midway between the first and second guides while the second print head is disposed substantially midway between the third and fourth guides.

5. A method of printing on both sides of a continuous sheet of printing material, the method comprising the steps of:

continuously rolling a first side of a sheet over a first guide and a second side of the sheet over a second guide;

printing on the first side of the sheet between the first guide and the second guide;

continuously rolling the second side of the sheet over a third guide and the first side of the sheet over a fourth guide; and printing on the second side of the sheet between the third guide and the fourth guide.

6. The method as claimed in claim 5 wherein each rolling step comprises the step of bending the sheet ninety degree over a roller.

7. The method as claimed in claim 6 wherein each printing step comprises the step of disposing a print head substantially midway between the guides.

8. A printing system for printing, cutting and stacking printed material from a continuous sheet of printing material, the system comprising:

a print engine having:

a first guide in contact with a first side of the sheet;

a second guide in contact with a second side of the sheet;

a first print head disposed between the first guide and the second guide for printing on the first side, a third guide in contact with the second side of the sheet;

a fourth guide in contact with the first side of the sheet; and a second print head disposed between the third guide and the fourth guide for printing on the second side;

a cutter for cutting the continuous sheet of printing material into pages; and a stacker adapted to lay the pages in a stack.

9. The printing system as claimed in claim 8 wherein the guides are rollers.

10. The printing system as claimed in claim 9 wherein each of the rollers defines a right-angle bend.

11. The printing apparatus as claimed in claim 10 wherein the first print head is disposed substantially midway between the first and second guides while the second print head is disposed substantially midway between the third and fourth guides.

* * * * *